United States Patent [19]

Williams

[11] Patent Number: 4,760,367

[45] Date of Patent: Jul. 26, 1988

[54] ELECTRIC FUSES

[75] Inventor: John F. Williams, Hampton Hill, England

[73] Assignee: Cranmer Projects Limited, Middlesex, England

[21] Appl. No.: 1,651

[22] PCT Filed: May 2, 1986

[86] PCT No.: PCT/GB86/00237

§ 371 Date: Mar. 3, 1987

§ 102(e) Date: Mar. 3, 1987

[87] PCT Pub. No.: WO86/06873

PCT Pub. Date: Nov. 20, 1986

[30] Foreign Application Priority Data

May 3, 1985 [GB] United Kingdom ..... 8511282

[51] Int. Cl.[4] ..... H01H 85/30

[52] U.S. Cl. ..... 337/241; 337/265

[58] Field of Search ..... 337/241, 242, 243, 265, 337/266; 29/623

[56] References Cited

U.S. PATENT DOCUMENTS

| | | | |
|---|---|---|---|
| 1,514,642 | 11/1924 | Werden | 337/241 |
| 2,737,552 | 3/1956 | Hitchcock | 337/241 |
| 3,182,153 | 5/1965 | Postal | 337/241 |
| 4,308,516 | 12/1981 | Shimada et al. | 337/241 |

FOREIGN PATENT DOCUMENTS

| | | |
|---|---|---|
| 1093482 | 12/1967 | United Kingdom . |
| 1549360 | 8/1979 | United Kingdom . |

*Primary Examiner*—H. Broome

*Attorney, Agent, or Firm*—Lowe, Price, LeBlanc, Becker & Shur

[57] ABSTRACT

An electric fuse link (10), which is preferably a cartridge fuse with a cylindrical ceramic body (11) with metal end caps (12), has means for indicating burning out of the fuse element. This consists of a conductive deposit (13) in parallel with the fuse element, but of higher resistance. This is preferably covered by a non-conductive deposit (14) of light color which prevents arcing and highlights burn-out of the conductive deposit when the element blows.

8 Claims, 1 Drawing Sheet

ELECTRIC FUSES

This invention relates to electric fuse links, in particular to cartridge fuse links, comprising one or more fuse elements enclosed in a cartridge filled with an arc extinguishing medium such as sand. However, the invention is applicable to fuse links other than the cartridge type.

Fuse links of the cartridge type, for example as used in domestic mains plugs in Great Britain, are thrown away from the fuse element has melted, and replaced with a fresh fuse link. A common difficulty is in knowing whether a particular fuse link has blown. Many attempts have been made to solve this problem, and many different 'indicators' have been developed, as evidenced, for example, by British Patent Specifications Nos. 1093428, 542059, 582594, 1415581 and 1549360, only some being directed to use with miniature cartridge fuse links. For various reasons, these different indicators have either not appealed to manufacturers or do not work. For example, those based on colour change of a pigment are extremely unreliable because the temperature change caused simply by the melting of a fuse link is usually quite small while the operating temperature of the fuse link is variable within much greater limits. Those involving explosives, spring release and others are expensive and notoriously unreliable.

Thus the common problem remains that of knowing whether a fuse link is still usable. The present invention aims to provide a fuse indicator which is reliable in operation, cheap to implement, and which can be applied to existing cartridge or other types of fuse link with little or no modification.

Accordingly, the invention proposes an electric fuse link comprising a fuse element and means for indicating burning out of the fuse element, wherein the indicating means comprises a conductive deposit which forms a conductive path in parallel with the fuse element of the fuse link but of higher resistance.

The deposit is preferably at least partly covered by a second non-conductive layer in order to prevent arcing and to render more visible the burn out of the conductive deposit.

According to a further feature of the invention there is provided a method of manufacturing an electric fuse link having a fuse element within a ceramic body, with metal end caps providing contacts with the fuse element characterised by the step of depositing on the outside of the ceramic body a conductive deposit which forms, or will form, a conductive path in parallel with the fuse element betwen the end caps.

In order that the invention shall be clearly understood, exemplary embodiments thereof will now be described, in conjunction with the accompanying drawings, in which.

For a cartridge fuse link, apart from the many physical characteristics, there are a number of main electrical criteria which must be met. These are:

1. The time taken to produce disconnection at given overcurrents must be less than a specified maximum; and greater than a specified minimum;

2. The total energy (usually expressed as $I^2t$) passed by the fuse link during operation must be within specified limits;

3. The electrical resistance of the fuse link after operation must be greater than a specified minimum;

4. In normal running, the fuse link must not dissipate too much energy (e.g. for a fuselink within BS 1362, the maximum specified is 1 watt at rated current).

Because of the different running conditions, and the different possible faults which can lead to fuse operation, the achievement of all these and other criteria, particularly in miniature cartridge fuse links, is difficult. The invention therefore aims to adopt the already well-developed cartridge fuse links on the market, which already meet these criteria, and to provide the necessary indicator without deleteriously disturbing the other characteristics.

Figure 1:
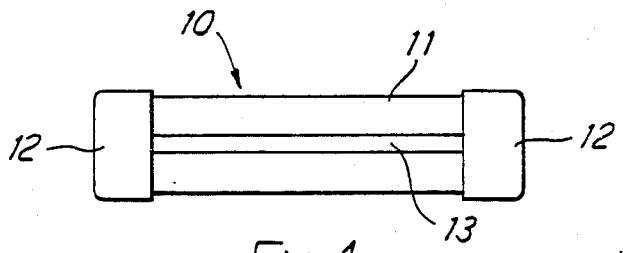
FIG. 1 shows a first embodiment of an electric fuse link according to the invention.

FIG. 1 shows the simplest form of the invention. A cartridge fuse link 10 for a British domestic mains plug has a ceramic body 11 with metal end caps 12. A fuse element extends between the end caps within the body, which is otherwise filled with sand as an arc extinguishing medium (the sand melts and absorbs the arc energy). It is not possible to see whether the fuse element is intact or not.

On the outside of the body is a conductive deposit 13 which is in electrical connection with the two end caps 12, and is thus in parallel with the fuse element within the cartridge body. The deposit 13 may be of uniform width eg. 0.5–1.2 mm and thickness, as shown, or may have one or more regions along its length of reduced width or thickness providing one or more regions of higher electrical resistance. The overall resistance between the endcaps of the deposit 13 must be considerably higher than that of the fuse element. For example, the resistance of a fuse element may be of the order of 0.005 ohms, while the conductive deposit 13 may have a resistance of between 200 ohms and 10,000 ohms. Thus, in normal running, the energy dissipation by the deposit would be minimal, and only a very small fraction of the dissipation in the fuse element itself. Thus the by-pass current does not influence the melting time of the element. Moreover, since the combined resistance of the fuse element and the deposit are reduced overall, so is the total dissipation.

When the fuse operates i.e. burns out or 'blows', it is the fuse element which melts first, and the deposit 13 then remains initially intact as a conductive link in the protected circuit. The voltage across and the current carried by the deposit rises sharply, its temperature increases, and in turn the deposit 13 burns out. However, since its resistance is higher, the operation is slower and less energetic than melting of the fuse element itself. The burn out may last up to a second, for example. Since it is external, the deposit can be examined to see whether it has blown or not, and this indicates whether or not the fuse element itself has blown. In practice, since probably the most useful deposits are graphite based, it can be rather difficult to see whether it has actually blown.

However, if a light coloured conductive deposit, for example a silver-based material, mixed with white pigment, is used the effect is more visible.

A further potential disadvantage, and danger, of the form of indicator described above is that arcing can occur at the point at which the deposit 13 burns out. This can ionise the air at that point, leading to further and potentially continuous arcing for the length of the fuse. Such an occurrence would not fulfil the normal safety requirements for fuses.

Figure 2:
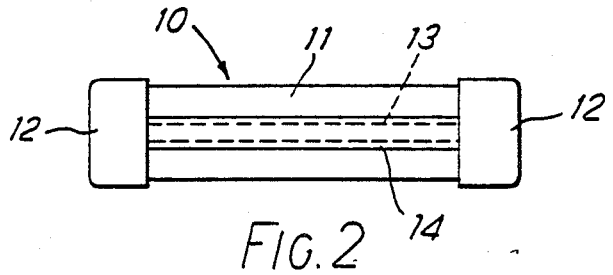
FIG. 2 shows a second embodiment.

In order to avoid the problem, a fuse link in accordance with FIG. 2 can be used. The cartridge fuse link is as described for FIG. 1, but the deposit 13 is completely covered by a further deposit 14, which at all points insulates it from the air. In this case, when the deposit 13 burns out, this occurs below deposit 14, and there is then no possibility of any arcing which does occur leading to ionisation of the air. The deposit 14 thus serves as an arc inhibiting and quenching means.

It has the further advantage that, if light in colour, it usually becomes discoloured by being burnt by the burning out of deposit 13 and this is usually easier to see than the burn out of the deposit 13 itself. Advantageously, the deposit 14 is white or a light colour.

In certain circumstances, the deposit 14 may cover only a part of the length of the deposit 13. This may be possible if the latter has a portion of reduced width or thickness, as mentioned above, which would be the portion which would burn out. It may then be sufficient to cover just this portion by deposit 14. In a further variant, a coloured deposit 14 may cover a part or whole of the deposit 13, and itself be covered by a yet further transparent deposit which serves as a protection against physical damage. A shellac varnish may be suitable for this.

The deposit 13, which must be conductive, can be of any suitable material and deposited in the most economical fashion. For example, conductive paints or inks employing graphite or silver may be used, and may be applied by spraying, printing, screen printing, brushing or by a continuously fed pen. Other metals, with or without a binder or adhesive, might be used. Vapour deposition may also be considered. There is merit in employing a minimum of adhesive or binder, and a minimum of conductive filter, because a potential problem is that a residual conductive track may be left after the deposit has burned out, which track may fail the test for the electrical resistance of the fuse link after operation. For this reason, it is preferred that when using a paint or ink this should have a nonorganic carrier, and the physical amount of the deposit should be kept to a minimum.

For the deposit 14, the latter considerations also apply, and in addition the pigment should also be non-conductive. It may indeed also be chosen for its ability to extinguish flame, such as an intumescent paint, and for its anti-tracking properties. The deposit is preferably light in colour, so that the burn out of deposit 13 is immediately obvious due to discoloration of layer 14. However, the deposit 14 should be able to withstand the maximum temperature (about 120° C.) which may occur in normal use of the fuse link without substantial discoloration which might obscure the evidence that the fuse has blown. A suitable material is white emulsion paint of high covering power, or a silicate based paint. These have a high content of white mineral solid and a low content of binder.

Figure 3:
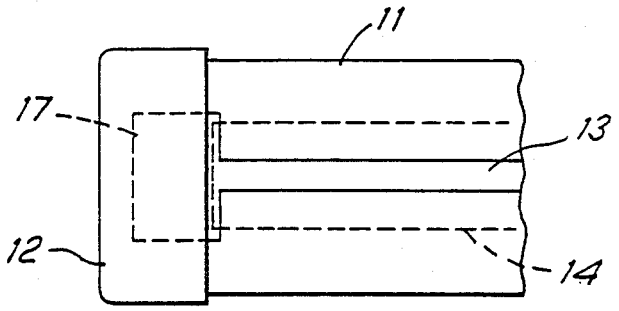
FIG. 3 shows an enlarged view of a modified form of deposit.

It is preferred to produce the conductive, and if required further, deposits on the ceramic fuse body before the latter is assembled into the fuse link. This allows the conductive deposit to extend the full length of the body so that contact is made directly to the inside of the end caps when the latter are clamped on. The further non-conductive deposits should not extend the full length of the conductive track so that the contact is not prevented thereby. Since the end cap is normally a tight interference fit, there would be a danger that the conductive deposit would be scraped off by the edge of the cap as it is forced on. This could lead to a defective junction between cap and deposit. It may be preferred, therefore, to introduce an enlarged contact area at the ends of the deposit, which area would not be fully covered by the end cap. This is illustrated in FIG. 3. The deposit 13 has an enlarged area 17 which lies almost but not quite completely under the end cap 12. This gives a good probability of edge contact between the end cap and the remainder of the area 7, and ensures that the eventual burn out of the deposit would not occur just at the ends of the narrow conductive track. The covering deposit 14 should cover the whole of the conductive track and preferably extend slightly over the area 17.

A suitable method of production would be the assembly of a matrix of bodies end to end and side by side in columns and rows in a shallow tray dimensioned to accept them compactly. Thus the deposits on one column would be end to end in a continuous line. The whole tray could be screen printed with deposit 13 in a single operation. An ink or paint of about 80/square would be appropriate. The tray could then be tunnel dried for about 2 minutes at about 200° C. Without disturbing the matrix, a similar screen printing of the deposit 14 would then be effected, followed by a further drying.

In practice, it appears that a resistance of between 200 and 10 K operates best, preferably between 400 and 2 K. The exact figure is determined by a number of factors, such as the compactness of the cross-section of the conductive deposit, the thickness of the further deposit, and the nature of that deposit. This is because it is necessary for the current flow to heat up the conductive deposit to both burn it out and mark the further deposit also by burning. If the resistance is too low, the conductive deposit blows too rapidly without dissipating energy for long enough to mark the further deposit; if the resistance is too high, or its cross-section is too spread, the conductive deposit never does burn out.

The invention has a further advantageous effect. Since a conductive path still remains temporarily after the fuse element itself has blown, this tends to inhibit the formation of a very high peak arcing voltage, thus improving the performance of the fuse link itself.

The invention overcomes all the problems previously encountered with indicator fuses in an extremely simple fashion. The additional cost is small in proportion to the cost of the rest of the fuse link, and the required deposit or deposits can be applied to pre-existing fuse links.

Since by means of the invention it is now possible to see whether a fuse link has blown or not, it is advantageous to form a plug top, or other fuse holder to receive the fuse link, with an aperture to enable the indicator to be seen.

The invention has been described with reference to a domestic British cartridge fuse link, as controlled by British Standard BS1362. However many other fuse links as covered by BS 88-1, 88-2, 88-4, 88-5, 1361 and 4265-1. and equivalent IEC standards, could also employ an indicator as described. Such fuse links are used in industrial applications, consumer units, feeder pillars, and in many other applications.

I claim:

1. An electric fuse link comprising a fuse element and means for indicating burning out of the fuse element, wherein the indicating means comprises a conductive deposit which forms a conductive path in parallel with the fuse element of the fuse link but of higher resistance, and a nonconductive deposit covering said conductive deposit over at least part of its length, said nonconductive deposit being light in color, whereby when said fuse element and said conductive deposit burnout said nonconductive deposit will discolor.

2. An electric fuse link as claimed in claim 1 which has a tubular ceramic body with metal end caps, wherein the conductive deposit is on the surface of the body and has portions which extend under the end caps to make contact therewith.

3. An electric fuse link as claimed in claim 2, wherein the portions are of greater width than the remainder of the deposit forming the conductive path.

4. An electric fuse link as claimed in claim 3, wherein the portions having greater width project beyond the edges of the end caps.

5. An electric fuse link as claimed in claim 4, wherein the conductive path has one section which is of higher resistance than the remainder.

6. An electric fuse link as claimed in claim 1, wherein the conductive deposit is a conductive paint or ink.

7. An electric fuse link as claimed in claim 6, wherein the conductive deposit is a paint or ink which is light in colour.

8. An electric fuse link as claimed in claim 1, wherein the resistace of the conductive deposit lies between 200Ω and 10 kΩ.

* * * * *